US005778505A

United States Patent [19]

Mangus et al.

[11] Patent Number: 5,778,505

[45] Date of Patent: Jul. 14, 1998

[54] APPARATUS FOR FASTENING A SEMI-CYLINDRICAL WORKPIECE

[75] Inventors: William W. Mangus, North Tonawanda; Gary W. Riehle, Elma; Larry J. Reilly, Kenmore, all of N.Y.

[73] Assignee: Gemcor Engineering Corporation, Buffalo, N.Y.

[21] Appl. No.: 923,231

[22] Filed: Sep. 4, 1997

Related U.S. Application Data

[63] Continuation of Ser. No. 317,367, Oct. 4, 1994, abandoned.

[51] Int. Cl.[6] ..... B23P 23/04; B21J 15/00

[52] U.S. Cl. ..... 29/34 B; 227/51

[58] Field of Search ..... 29/34 B, 243.53, 29/243.54, 525.01; 483/28, 29; 227/51, 55, 61, 62, 99, 110; 72/450, 352

[56] References Cited

U.S. PATENT DOCUMENTS

| | | | |
|---|---|---|---|
| 26,134 | 11/1859 | Rodgers | 227/51 X |
| 4,864,713 | 9/1989 | Roberts et al. | 29/524.1 |
| 4,897,000 | 1/1990 | Suzuki | 227/51 X |
| 4,908,928 | 3/1990 | Mazurik et al. | 29/525.1 |
| 5,060,362 | 10/1991 | Birke et al. | 29/525.2 |
| 5,060,375 | 10/1991 | Demichel | 29/243.54 |
| 5,329,691 | 7/1994 | Roberts et al. | 29/705 |
| 5,367,435 | 11/1994 | Matsuda | 483/28 X |
| 5,410,904 | 5/1995 | Hirata et al. | 72/446 |

FOREIGN PATENT DOCUMENTS

| | | | |
|---|---|---|---|
| 129866 | 1/1985 | European Pat. Off. | 483/29 |
| 1008552 | 4/1954 | Germany | 29/243.54 |
| 4134414 | 4/1993 | Germany | 29/243.53 |
| 924650 | 10/1974 | U.S.S.R. | 29/243.53 |
| 1165526 | 7/1985 | U.S.S.R. | 29/243.53 |

*Primary Examiner*—William R. Briggs
*Attorney, Agent, or Firm*—Hodgson, Russ, Andrews, Woods & Goodyear LLP

[57] ABSTRACT

Machining apparatus comprising a major C-frame for carrying an upper tooling head and a rotatable minor C-frame for carrying a lower tooling head cantileverly supported away from a body portion of the minor C-frame to provide a throat for receiving a workpiece edge portion while another workpiece portion is positioned between the heads for machining, the minor C-frame being rotated to provide clearance for the workpiece. As a result, a substantially semi-cylindrical workpiece may be machined over its surface without refixturing thereof.

20 Claims, 6 Drawing Sheets

APPARATUS FOR FASTENING A SEMI-CYLINDRICAL WORKPIECE

This is a continuation of application Ser. No. 08/317,367 filed on Oct. 4, 1994, now abandoned.

The present invention relates generally to the machining of workpieces. More particularly, the present invention relates to installing fasteners and otherwise machining a workpiece clamped between two heads.

In the aircraft industry, fuselages may be formed as a pair of arcuate or semi-cylindrical fuselage panels which are subsequently attached. Various fastening and other machining operations are required on each of the semi-cylindrical workpieces, i.e., to rivet together skin, stringers, and frame. Such operations involve placing a workpiece between a pair of heads, inserting a rivet, and deforming both of its ends during riveting. Such riveting or other machining may be required over the entire 180 degree arc of the workpiece.

U.S. Pat. No. 5,060,362 to Birke et al, which is assigned to the assignee of the present invention and the disclosure of which is incorporated herein by reference, discloses riveting apparatus having a pair of riveting heads between which a workpiece is held to be riveted, the workpiece being clamped in a rigid fixture for movement between the heads. Other examples of such riveting apparatus are found in U.S. Pat. Nos. 4,864,713 and 5,329,691 to Roberts et al and 4,908,928 to Mazurik et al which are also incorporated herein by reference and also assigned to the assignee of the present invention.

Such an apparatus is illustrated schematically generally at 20 in FIG. 1. The upper and lower riveting heads 22 and 24 respectively are connected to a C-frame 26. Accordingly, the upper head 22 is cantileverly positioned away from a vertical body portion 28 of the C-frame so as to allow space for the workpiece 30 being riveted. A rigid fixture or workframe for holding the workpiece 30 is illustrated at 38. A subframe 32 is carried by the upper portion 34 of the C-frame 26 for fore and aft movement (transverse to the workpiece 30) of the upper head 22, as illustrated by arrow 36, for the purpose of supporting the upper head. The lower head 24 is connected to a frame or support 40 containing a hydraulic cylinder for effecting vertical movement of the lower head 24. As depicted in FIG. 1 as well as shown in Birke et al, the support for the lower head 24 may be called an I-frame which is supported by the lower portion 42 of the C-frame.

As seen in FIG. 1, such riveting apparatus 20 conventionally found in the art does not allow riveting along an entire 180 degree arc of a semi-cylindrical fuselage panel 30 due to the straight up I-frame 40 obstructing the longitudinal edges of the panel 30 thereby preventing the portions of the panel 30 along the edges from being disposed between the heads 22 and 24 for riveting, i.e., I-frame 40 does not provide adequate clearance for wrapping around of the workpiece. Thus, the conventional riveting apparatus 20 having I-frame 40 does not allow an arcuate or semi-cylindrical workpiece to be riveted without refixturing the workpiece 30 on the system workframe 38. Such refixturing is time consuming and labor intensive resulting in greater cost for producing the product.

It is accordingly an object of the present invention to fully fasten arcuate or semi-cylindrical workpieces without refixturing them.

In accordance with the present invention, workpiece machining apparatus is provided wherein both upper and lower machining heads are mounted to C-frames or otherwise cantileverly mounted to achieve the clearance necessary for movement of an arcuate workpiece over substantially an entire 180 degree arc between the heads for machining so that the workpiece need not be refixtured during machining thereof.

The above and other objects, features, and advantages of the present invention will be apparent in the following detailed description of the preferred embodiment thereof taken in conjunction with the accompanying drawings wherein the same reference numerals denote the same or similar parts throughout the several views.

DETAILED DESCRIPTION OF THE PREFERRED EMBODIMENT

Figure 1:
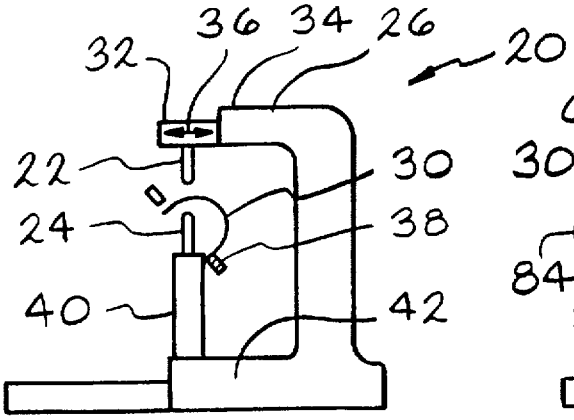
FIG. 1 (PRIOR ART)
FIG. 1 is a schematic view of apparatus in accordance with the prior art.

Referring to FIGS. 2 to 13, there is shown generally at 50 apparatus for fastening portions such as skin, stingers, and frame of a semi-cylindrical fuselage panel or other arcuate workpiece 30. Apparatus 50 includes workpiece holding apparatus 110 and tooling apparatus 67 for riveting the workpiece 30. The apparatus 50 is preferably a seven-axis CNC riveter system so that the riveting process may in general be aligned normal to any point on the workpiece 30. A rivet (not shown) is inserted in a conventional manner in aligned apertures (not shown) in the workpiece portions. The tooling apparatus 67 includes upper and lower heads 52 and 54 for upsetting the rivet to form a fastened joint.

Figure 10:
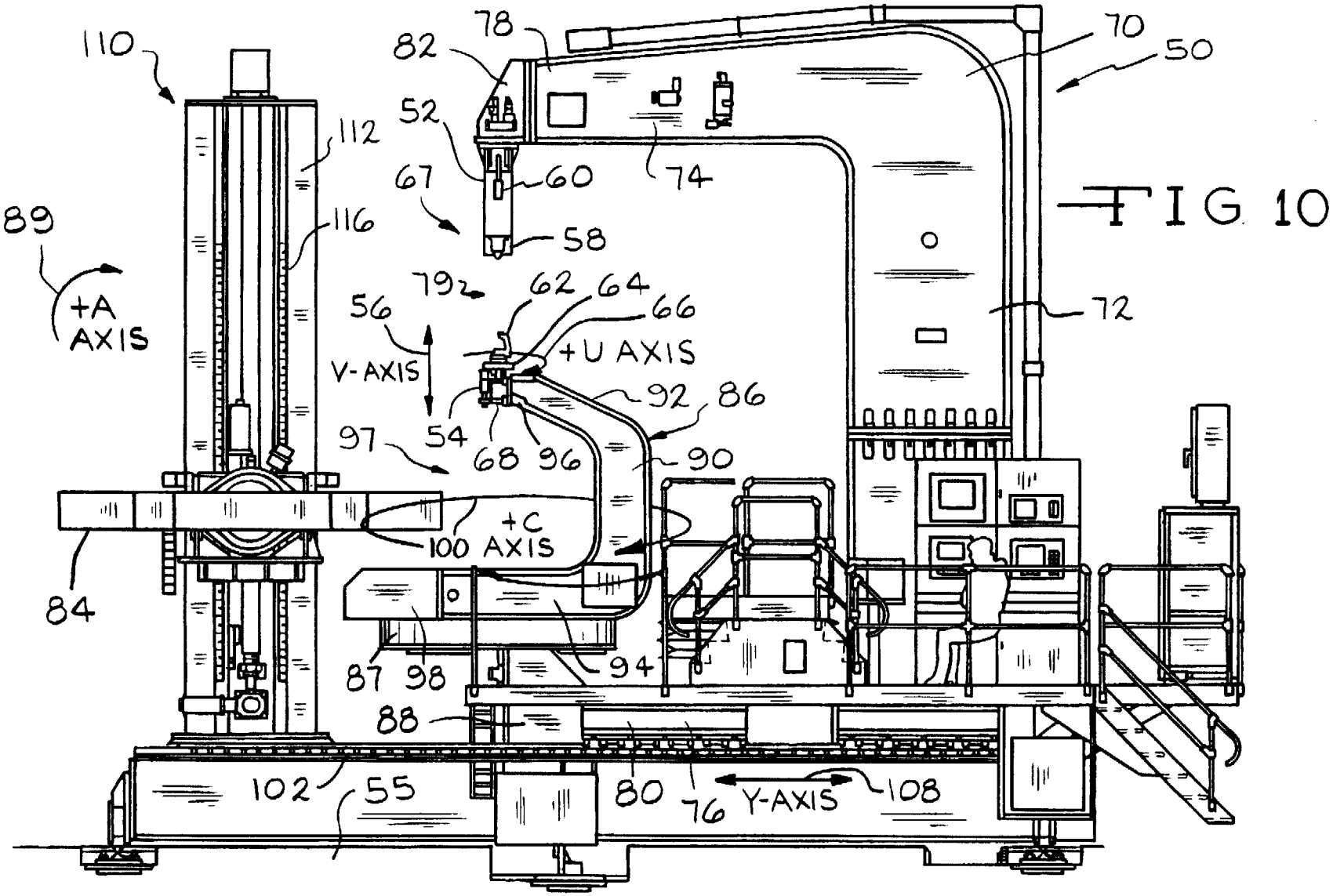
FIG. 10 is a side elevation view thereof.
Figure 11:
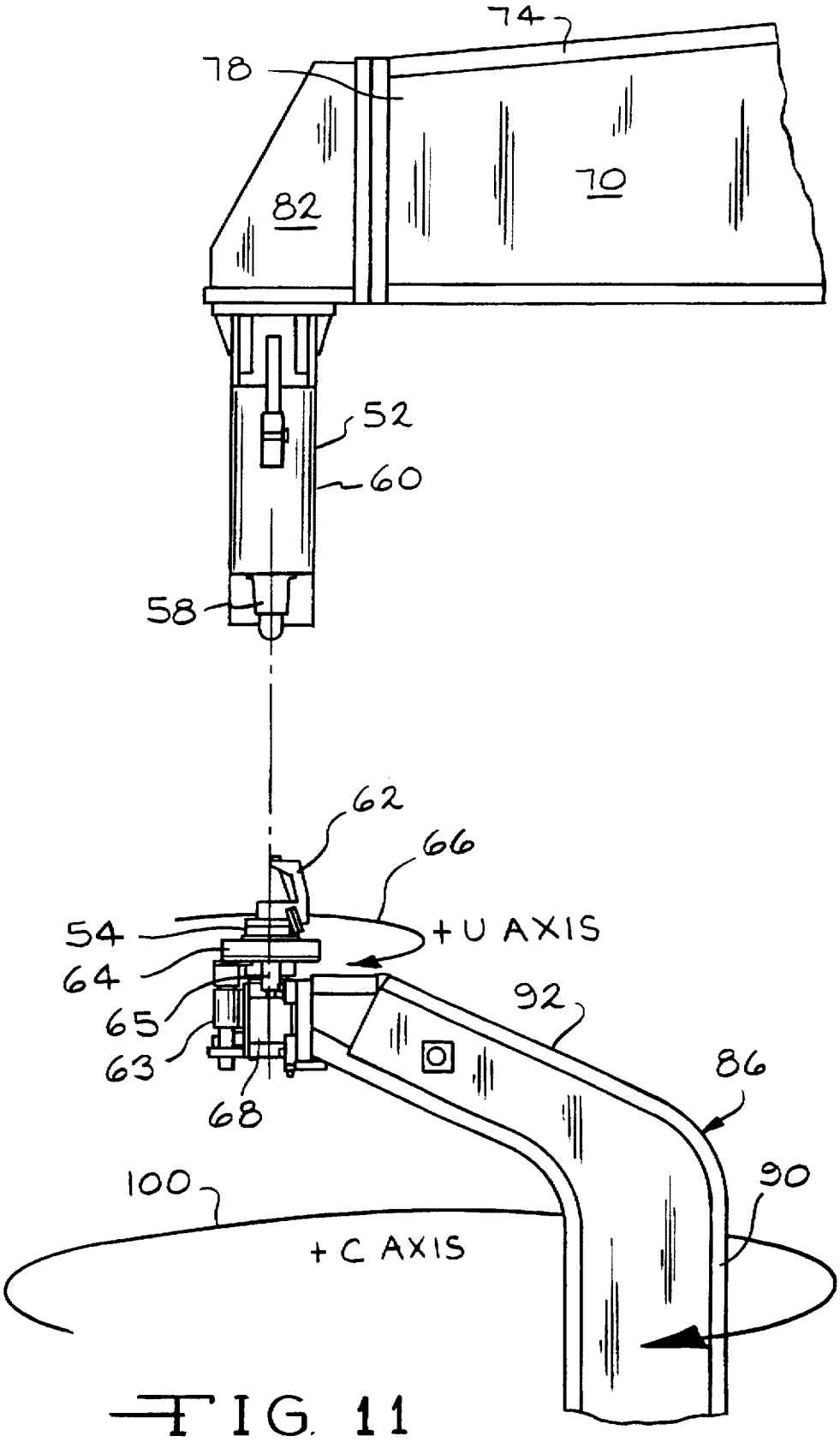
FIG. 11 is an enlarged view of riveting heads therefor.

Upper head 52 contains a rivet forming die 58 shown in FIGS. 10 and 11 carried by riveting ram or cylinder 60 and which forms a head on the rivet during upset according to principles commonly known to those of ordinary skill in the art to which this invention pertains. Lower head 54 contains an offset rivet upset anvil 62 suitably mounted on a turntable 64 powered by an AC brushless servo motor 65 for rotation thereof (U-axis), as illustrated at 66, through a sufficient number of degrees of angular rotation to position the offset rivet anvil 62. Rivet upset is achieved by operation of upset cylinder 68 after the workpiece 30 is suitably clamped by pressure cylinders (not shown) carried by the respective heads 52 and 54 as is commonly known in the art, the clamping cylinder for the lower head 54 being internal of the upset cylinder 68. At 63 in FIG. 11 is a U-axis turntable anti-rotation mechanism.

The upper and lower heads 52 and 54 respectively as described above are conventional and therefore will not be described in greater detail. The upper and lower heads 52 and 54 respectively are meant to refer to tooling for engaging opposite ends respectively of a rivet for upset or deforming thereof into a rivet for connecting two or more workpiece portions. However, it should be understood that, in accordance with the present invention, upper and lower heads may be provided for various other machining operations.

The upper head 52 is suitably connected to and supported by a C-frame 70, as described in greater detail hereinafter.

C-frame 70 has generally the shape of a "C" defining a throat 71 and having a vertical or body portion 72 as shown in FIG. 10, an upper generally horizontal (or horizontally-extending) portion 74, and a lower generally horizontal (or horizontally extending) portion 76. Horizontal portions 74 and 76 are vertically spaced and have terminal ends 78 and 80 respectively at the entrance 79 to the throat. Terminal ends 78 and 80 are spaced horizontally from vertical portion 72. As used herein and in the claims, a "C-frame" is meant to refer to a frame having a central portion and a pair of end portions having terminal ends wherein a straight line connecting the terminal ends is spaced from the central portion. A throat is defined between the pair of end portions of the frame.

A subframe 82 in the form of a bracket is carried by C-frame 70 at the terminal end 78 as shown in FIG. 10. The upper head 52 containing hydraulic cylinder 60 is connected to the subframe 82 so that the upper head 52 is spaced horizontally from vertical frame portion 72 so that clearance may be provided for workpiece 30 when it is disposed between the heads 52 and 54 for riveting. Thus, it may be said that the upper head 52 is cantileverly supported at a distance from the C-frame body portion 72.

Figure 12:
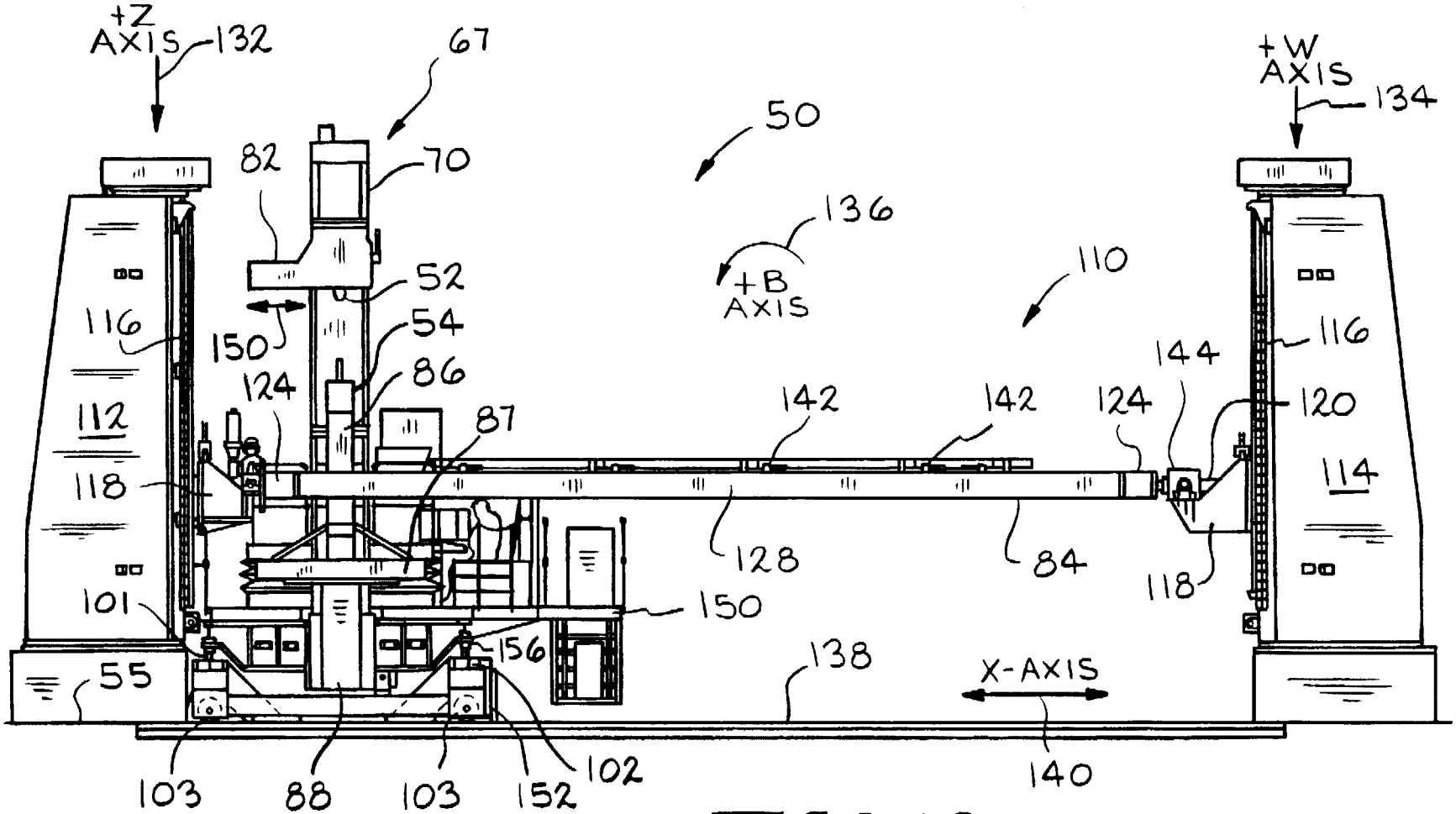
FIG. 12 is a front elevation view thereof.
Figure 13:
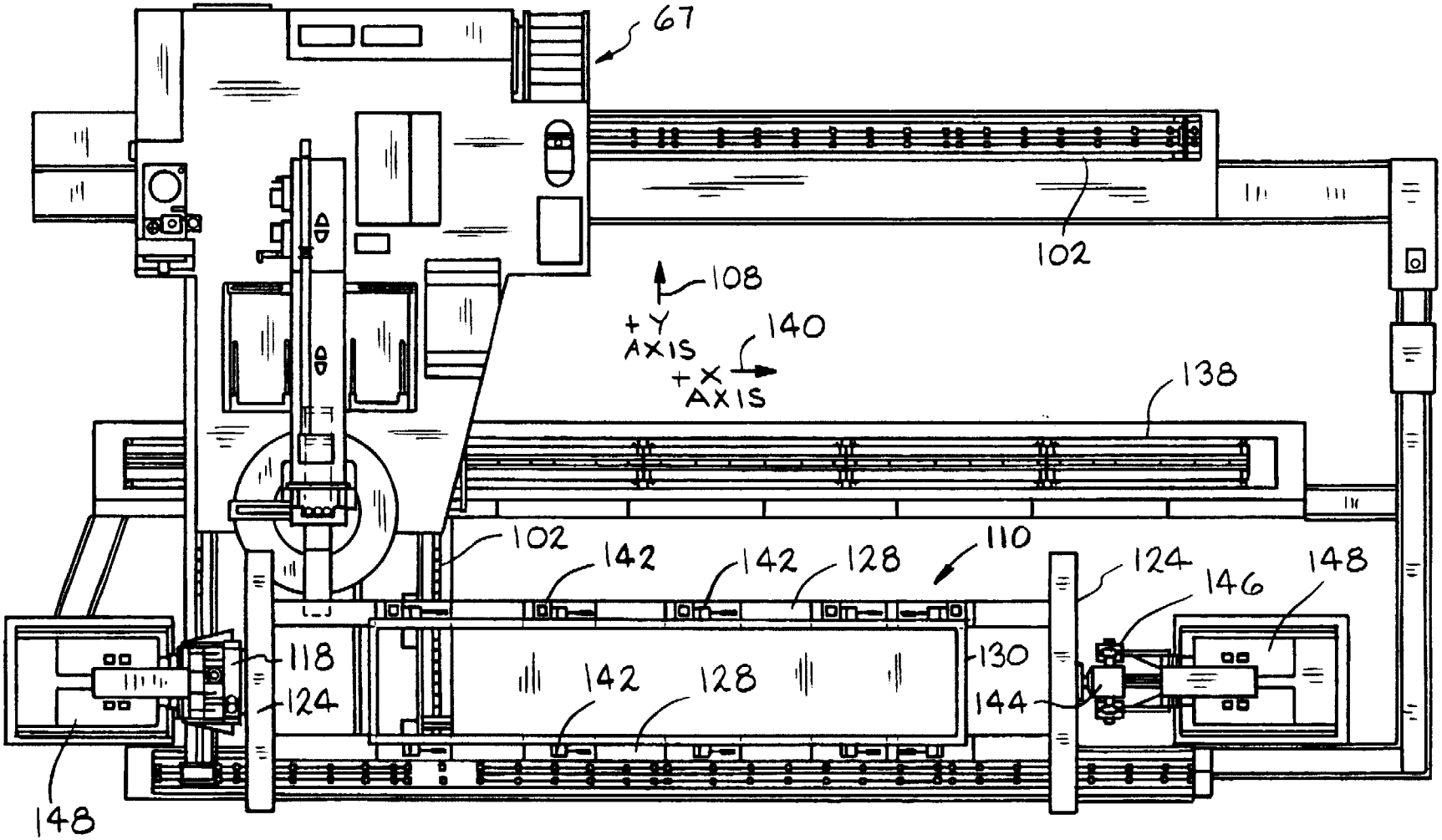
FIG. 13 is a top view thereof.

The workpiece 30 is held by workpiece holding apparatus 110 shown in FIG. 12 which includes a pair of spaced substantially identical vertical piers or counterbalances 112 and 114 which are rigidly secured to a floor 55 or other supporting surface. Each of the piers 112 and 114 includes a vertically extending track 116 such as a ball screw drive for raising and lowering a carriage 118. A shaft 120 is journalled in a suitable spherical bearing (not shown) carried by each carriage 118. The workframe or support network 84 including left and right transversely extending box frame members 124 and front and rear box beams 128 is secured to the opposed shafts 120. Supported or fixtured within the open rigid fixture or workframe 84 defined by the various members 124 and 128 by pneumatic clamps 142 is the workpiece 30. Rotation of the workframe 84 and workpiece 30 into riveting position (A-axis), as illustrated at 89 in FIG. 10, may be controlled suitably such as by an AC brushless servo motor (not shown) mounted on one of the carriages 118. The separate carriages 118 are independently operable vertically so that the ends of the workpiece assembly 30 may be moved independently up and down (Z and W axes), illustrated at 132 and 134 respectively as shown in FIG. 12. The combination of the Z and W axes allows the workpiece assembly 30 to be tilted (B-axis), as illustrated at 136, to insure component to spindle perpendicularity. Rotation of the workpiece assembly 30 is about a line which extends between the ends of the workpiece assembly 30 (A-axis), as illustrated at 89 in FIG. 10. These movements of the workpiece assembly 30 through perhaps about 190 degrees rotation allow it to be properly positioned so that it lies in the operational workplane of the tooling apparatus 67 as well as simplifying load and unload operations via vertical positioning of the workframe. The workpiece 30 may, for example, be a small diameter (perhaps 38 inches minimum diameter) semi-cylindrical section of a fuselage such as an upper cabin section.

Figure 2:
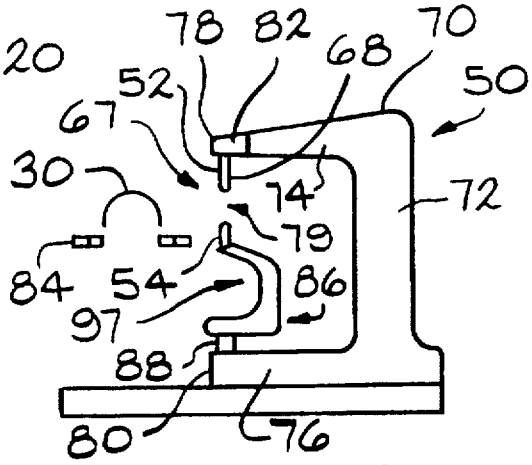
FIGS. 2 to 9 are schematic views of apparatus according to the present invention with a semi-cylindrical workpiece positioned between two heads for riveting at various angular positions over the arc thereof.

FIG. 2 illustrates the workpiece 30 prior to its insertion between the heads 52 and 54, which are shown spaced apart for receiving the workpiece 30. Insertion may be achieved by combined movements of the tooling 67 and the workframe 84.

Lower head 54 is supported by a frame 86 which is in turn supported by a hydraulic cylinder 88 for movement (V-axis) thereof vertically toward and away from upper head 52, as illustrated at 56 in FIG. 10. The cylinder 88 is supported by the lower terminal end portion of C-frame 70 so as to be spaced horizontally from and to space the lower head 54 horizontally from C-frame body portion 72. Thus, it may also be said that the lower head 54 is cantileverly supported at a distance from C-frame body portion 72 (at the throat entrance 79) and in alignment with the upper head 52 for riveting. Being supported by C-frame 70, frame 86 may be said to be a "minor frame" which is generally contained within C-frame 70, which may accordingly be called a "major frame." Minor frame 86 is suitably mounted on AC brushless programmable servo motor-controlled turntable 87 for rotation (C-axis), as illustrated at 100 in FIGS. 10 and 11, through perhaps about 350 degrees to allow for proper positioning of the minor frame 86 relative to the workpiece 30 and fixturing 84, as discussed hereinafter. The lower head or ram 54 which is mounted to the top of minor C-frame 86 is suitably mounted to contain an additional 710° of rotation (U-axis) to position rivet anvil 62.

Figure 3:
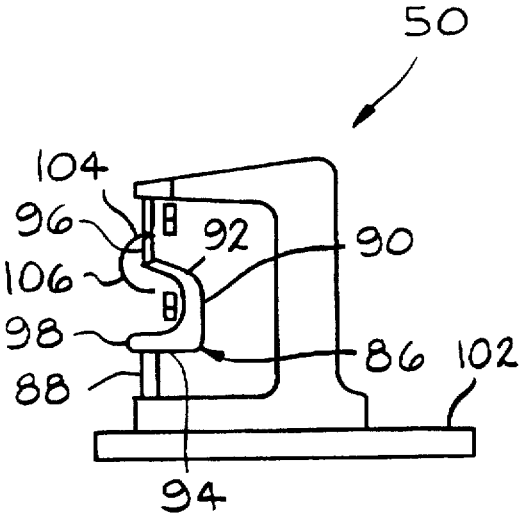
Figure 4:
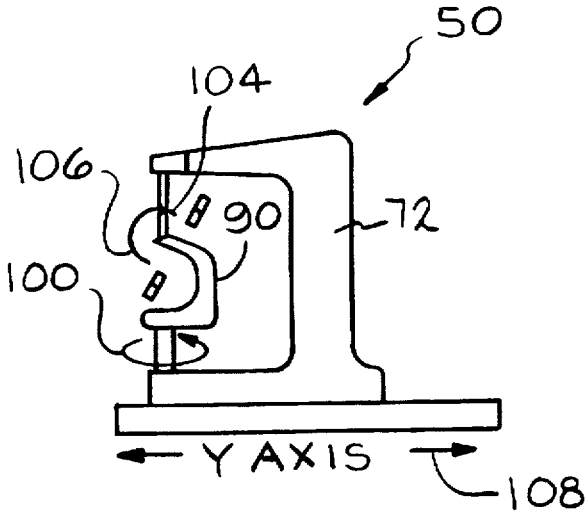
Figure 6:
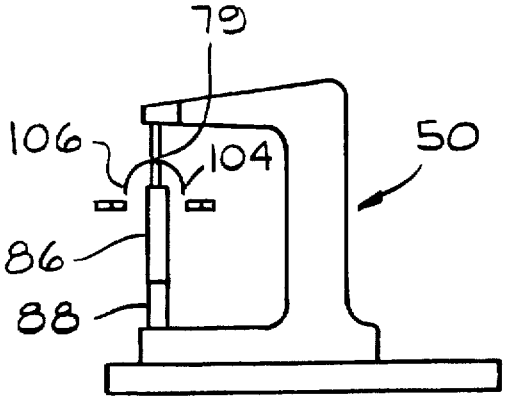
Figure 7:
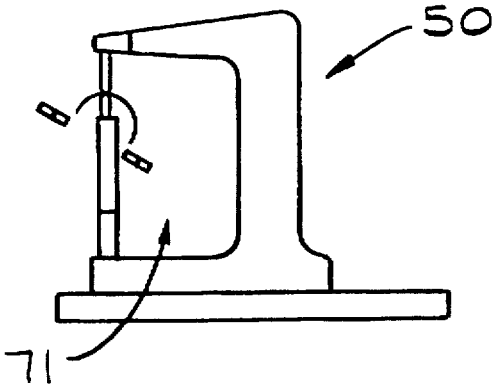

If frame 86 were to have an "I-shape", it would obstruct or interfere with the movements of workpiece longitudinal edges thereby preventing both longitudinal edge portions of semi-cylindrical workpieces from being riveted without refixturing of the workpiece 30, as illustrated in and previously discussed relative to FIG. 1. In order to prevent the frame 86 from interfering with or obstructing the positioning of the workpiece 30 so that it may be riveted over the entirety of an 180 degree arc without refixturing thereof, in accordance with the present invention, the frame 86 is generally C-shaped, having a vertical or body portion 90 and upper and lower portions 92 and 94, respectively, as shown in FIG. 10, extending generally horizontally to terminal ends 96 and 98 respectively to define therebetween a throat, illustrated at 97. The lower head 54 is connected to the upper terminal end portion 96 of minor C-frame 86 to be spaced or offset horizontally from body portion 90. As seen in the drawings, the upper portion 92 of the minor C-frame 86 may be slanted upwardly so that the lower head 54 is also offset vertically from body portion 90. It may thus be said that the lower head 54 is cantileverly supported at a distance from the body portion 90. The hydraulic cylinder 88 is connected to the lower terminal end portion 98 of minor C-frame 86 to also be spaced horizontally from body portion 90 and to be in vertical alignment with lower head 54. Rotation of the minor C-frame 86 about the C-axis, as illustrated at 100, allows the upper and lower heads 52 and 54 to respectively remain in alignment for riveting. The minor C-frame 86 is thus rotatable between a position wherein body portion 90 is at the closest location relative to major C-frame body portion 72, as illustrated in FIGS. 2 to 4, and a position wherein it is farthest away from major C-frame body portion 72, as illustrated in FIGS. 8 and 9, and locations between those positions, as illustrated in FIGS. 5 to 7.

FIG. 2 illustrates the major C-frame 70 in a retracted position, i.e., away from the workframe 84 and semi-cylindrical workpiece 30, which may, for example, be an upper cabin fuselage section. In FIG. 2 workpiece 30 is oriented in what is defined as the initial or 0° position. FIG. 3 illustrates the C-frame structure 70 after having been moved, as discussed hereinafter, in the Y-axis direction (transverse to workpiece 30), as illustrated at 108 in FIG. 4, to receive one longitudinal edge portion 104 of the workpiece 30 between the heads 52 and 54 for riveting, the workpiece 30 having been moved by the workframe 84 so that the edge portions 104 and 106 are generally in vertical alignment. This is the −90° position of workpiece 30. Rails 138 are suitably rigidly mounted to the floor 55 and receive the X-axis carriage, illustrated at 152 in FIG. 12. The X-axis drive may suitably be a pivot bracket arrangement known to those skilled in the art. The offset horizontally of the vertical body portion 90 of the minor C-frame 86 from the lower head 54 allows the clearance for edge portion 106 (whereby it is received within throat 97) so that edge portion 104 can be inserted between the heads 52 and 54. FIG. 4 illustrates the workpiece 30 in the −60° position with the body portion 90 of the minor C-frame 86 still located closest to the body portion 72 of the major C-frame 70.

Figure 5:
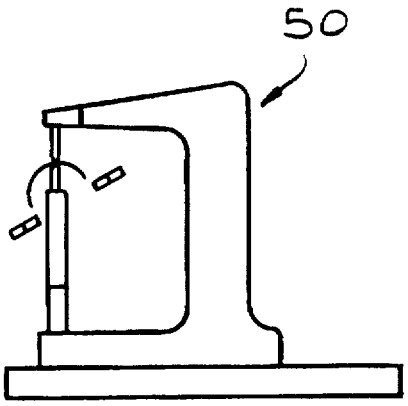

FIG. 5 illustrates the workpiece 30 in the −30° position. In order to prevent the workpiece edge portion 104 from being obstructed by the generally horizontal upper portion 92 of the minor C-frame 86 as the workpiece is moved to this position, the minor C-frame 86 is rotated 90 degrees about the C-axis so that upper portion 92 thereof is out of the way of workpiece edge portion 104. The minor C-frame 86 remains in this position as the workpiece 30 is rotated through the 0° and 30° positions illustrated in FIGS. 6 and 7 respectively.

Figure 8:
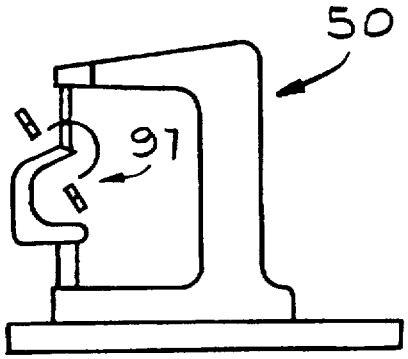
Figure 9:
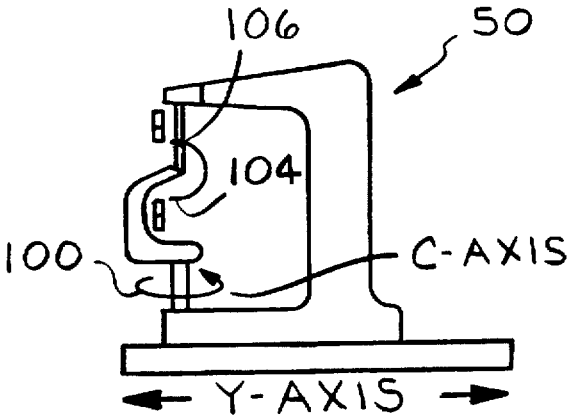

FIG. 8 illustrates the workpiece 30 in the 60° position. In order to prevent the workpiece edge portion 104 from being obstructed by the minor C-frame 86 as the workpiece is moved to this position, the minor C-frame 86 is rotated through another 90 degrees about the C-axis so that its body portion 90 is located farthest away from the major C-frame body portion 72 to allow clearance for the workpiece edge portion 104 (whereby it is inserted in the throat 97). The minor C-frame 86 remains in this position as the workpiece 30 is rotated to the 90° position illustrated in FIG. 9 wherein the workpiece edge portion 106 is disposed between the heads 52 and 54 for riveting.

The semi-cylindrical workpiece 30 is shown to be positioned between the heads 52 and 54 over the entirety of its 180° arc for riveting without refixturing thereof. Thus, the minor C-frame 86 is rotatable about the C-axis, as illustrated at 100, as needed to get portions of the minor C-frame 86 out of the way of a workpiece edge as it is positioned for riveting, thusly to advantageously eliminate the need for refixturing the workpiece 30.

The tooling 67 is movable on rails 138 by means of a pinion (not shown) powered by an AC brushless servo motor, illustrated at 103, for driving along a rack on rails 138, along the length of the workpiece 30 (X-axis) for riveting thereof, as illustrated at 140 in FIG. 12. The tooling 67 is positioned on the Y-axis carriage, illustrated at 150, and the Y-axis guides 102 are mounted on top of the X-axis carriage 152. The Y-axis carriage assembly 150 may be driven by an AC brushless servo motor and a ball screw/nut arrangement, illustrated at 156. Other suitable arrangements may be provided for moving the tooling along the X-axis and Y-axis.

If the subframe 82 is attached to the major C-frame in a manner allowing movement of the upper head 52 in a direction parallel to the Y-axis (transverse to the workpiece) as illustrated for sub-frame 32 in FIG. 1, it would undesirably interfere with angular movement of the workpiece and associated fixture clamps. In order that this not occur, in accordance with the present invention, the subframe 82 is suitably attached to the terminal end 78 of the major C-frame 70 to allow movement of the upper head 52 in a direction parallel to the X-axis (parallel to the workpiece length), as illustrated at 150 in FIG. 12, in order to move head 52 out of the way of the fixture clamp as the workpiece is rotated about the X-axis.

While the method and apparatus of the present invention have been described in connection with installing fasteners in fuselage sections, the present invention can be used for installing fasteners in wing panels and other curved panels, in fact for machining any kind of curved workpiece. Rivets and various other types of fasteners can be installed in workpieces using the method and apparatus of the present invention. Furthermore, the orientation of the apparatus is not critical and can be adjusted from the illustrative orientation shown in the drawings to other orientations to accommodate various orientations of fixtures and parts.

Various conventional components of riveting apparatus which do not form part of the present invention are not discussed herein or are only discussed generally, it being within the knowledge of one of ordinary skill in the art to which this invention pertains to make riveting apparatus incorporating the present invention using the information contained herein and in the patents previously discussed.

It should be understood that while the present invention has been described in detail herein, the invention can be embodied otherwise without departing from the principles thereof, and such other embodiments are meant to come within the scope of the present invention as defined in the appended claims.

What is claimed is:

1. Apparatus comprising first and second head means which are located along an axis for machining a curvilinear workpiece held therebetween, frame means including first and second C-frames for holding said first and second head means respectively, said first C-frame being disposed substantially in a plane and said workpiece having a longitudinal axis disposed substantially perpendicular to said plane, means for fixturing the workpiece and for moving the fixtured workpiece between said first and second head means for positioning of the workpiece at various positions thereof for machining, and means for rotating said second C-frame about said axis to provide clearance for the workpiece including the longitudinally extending edges thereof in the various positions thereof for machining.

2. Apparatus according to claim 1 wherein the apparatus is fastening apparatus.

3. Apparatus comprising first and second head means which are located along an axis for machining a curvilinear workpiece held therebetween, frame means including first and second C-frames for holding said first and second head means respectively, means for fixturing the workpiece and for moving the fixtured workpiece between said first and second head means for positioning of the workpiece at various positions thereof for machining, means for rotating said second C-frame about said axis to provide clearance for the workpiece in the various positions thereof for machining, and means for moving said first head means substantially parallel to a longitudinal axis of the workpiece.

4. Apparatus comprising first and second head means which are located along an axis for machining a curvilinear workpiece held therebetween, a major C-frame means for supporting said first head means and defining a throat, a minor C-frame means disposed at least partially within the major C-frame means throat for supporting said second head means, means for fixturing the workpiece and for moving the fixtured workpiece between said first and second head means for positioning of the workpiece in various positions for machining, means for rotating said minor C-frame means about said axis to provide clearance for the workpiece in the various positions for machining, and means for moving said first head means substantially parallel to a longitudinal axis of the workpiece.

5. Apparatus comprising first and second head means which are located along an axis, a first generally C-shaped frame means for supporting said first head means, a second generally C-shaped frame means for supporting said second head means for machining a substantially semi-cylindrical workpiece which is fixtured and which is held between said first and second head means over the curvature thereof without refixturing of the workpiece, means for moving the fixtured workpiece between said first and second head means for positioning of the workpiece at various positions for machining, means for rotating said second generally C-shaped frame means to provide clearance for the workpiece in the various positions thereof for machining, and means for moving said first head means substantially parallel to a longitudinal axis of the workpiece.

6. Apparatus comprising first and second head means which are located along an axis, a first frame means including a body portion and means for cantileverly supporting said first head means at a distance from said body portion, a second frame means including a body portion and means for cantileverly supporting said second head means at a distance from said second frame means body portion for machining of an arcuate workpiece which is fixtured and which is held between said first and second head means over the curvature thereof without refixturing of the workpiece, means for moving the fixtured workpiece between said first and second head means for positioning of the workpiece at various positions for machining, means for rotating said second frame means about said axis to provide clearance for the workpiece in the various positions thereof for machining, and means for moving said first head means substantially parallel to a longitudinal axis of the workpiece.

7. Apparatus comprising first and second head means which are located along an axis for machining a curvilinear workpiece held therebetween, a first frame means shaped to define a throat having an entrance and supporting said first head means at said throat entrance, a second frame means shaped to define a throat and disposed at least partially in said first frame means throat and supporting said second head means, means for moving said second frame means while maintaining said second head means in alignment with said first head means whereby an edge portion of an arcuate workpiece which is fixtured may be received in the second frame means throat while another portion thereof is held between the first and second head means for machining over the workpiece curvature without refixturing of the workpiece, means for moving the fixtured workpiece between said first and second head means for positioning of the workpiece at various positions thereof for machining, means for mounting said second frame means for rotating about said axis to provide clearance of the workpiece in the various positions thereof for machining, and means for moving said first head means substantially parallel to a longitudinal axis of the workpiece.

8. Apparatus comprising first and second head means which are located along an axis, a first frame means including a main body portion and a portion extending from said main body portion and supporting said first head means in offset spaced relation to said main body portion of said first frame means, a second frame means including a main body portion and a portion extending from said main body portion of said second frame means and supporting said second head means in offset spaced relation to said main body portion of said second frame means, means for fixturing an arcuate workpiece and for moving the fixtured workpiece between said first and second head means for positioning of the workpiece in various positions thereof for machining, said first frame means being disposed substantially in a plane and said workpiece having a longitudinal axis disposed substantially perpendicular to said plane, and means for rotating said second frame means about said axis for accommodating positioning of the arcuate workpiece including the longitudinally extending edges thereof between said first and second head means for machining over the curvature thereof without refixturing of the workpiece.

9. Apparatus comprising first and second head means which are located along an axis for machining a curvilinear workpiece held therebetween, a major C-frame means for supporting said first head means and defining a throat, said major C-frame means being disposed substantially in a plane and said workpiece having a longitudinal axis disposed substantially perpendicular to said plane, a minor C-frame means disposed at least partially within the major C-frame means throat for supporting said second head means, means for fixturing the workpiece and for moving the fixtured workpiece between said first and second head means for positioning of the workpiece in various positions for machining, and means for rotating said minor C-frame means about said axis to provide clearance for the workpiece including the longitudinally extending edges thereof in the various positions for machining.

10. Apparatus according to claim 9 wherein the apparatus is fastening apparatus.

11. Apparatus according to claim 8 wherein said first and second frame means are sized and configured so that said second frame means is movable within said first frame means.

12. Apparatus comprising first and second head means which are located along an axis, a first frame means including an elongate first body portion and a portion extending laterally from said first body portion and supporting said first head means laterally spaced from said first body portion, a second frame means including an elongate second body portion and a portion extending laterally from said second body portion and supporting said second head means laterally spaced from said second body portion, means for fixturing an arcuate workpiece and for moving the fixtured workpiece between said first and second head means for positioning of the workpiece in various positions thereof for machining, said first frame being disposed substantially in a plane and said workpiece having a longitudinal axis disposed substantially perpendicular to said plane, and means for rotating said laterally extending portion of said second frame means about said axis for accommodating positioning of the arcuate workpiece including the longitudinally extending edges thereof between said first and second head means for machining over the curvature thereof without refixturing of the workpiece.

13. Apparatus according to claim 12 wherein said first and second frame means are sized and configured so that said second frame means is movable within said first frame means.

14. Apparatus comprising first and second head means which are located along an axis, a first generally C-shaped frame means for supporting said first head means, a second generally C-shaped frame means for supporting said second head means for machining a substantially semi-cylindrical workpiece which is fixtured and which is held between said first and second head means over the curvature thereof without refixturing of the workpiece, said first generally C-shaped frame means being disposed substantially in a plane and said workpiece having a longitudinal axis disposed substantially perpendicular to said plane, means for moving the fixtured workpiece between said first and second head means for positioning of the workpiece at various positions for machining, and means for rotating said second generally C-shaped frame means to provide clearance for the workpiece including the longitudinally extending edges thereof in the various positions thereof for machining.

15. Apparatus according to claim 14 wherein the apparatus is fastening apparatus.

16. Apparatus comprising first and second head means which are located along an axis, a first frame means including a body portion and means for cantileverly supporting said first head means at a distance from said body portion, a second frame means including a body portion and means for cantileverly supporting said second head means at a distance from said second frame means body portion for machining of an arcuate workpiece which is fixtured and which is held between said first and second head means over the curvature thereof without refixturing of the workpiece, said first frame means being disposed substantially in a plane and said workpiece having a longitudinal axis disposed substantially perpendicular to said plane, means for moving the fixtured workpiece between said first and second head means for positioning of the workpiece at various positions for machining, means for rotating said second frame means about said axis to provide clearance for the workpiece including the longitudinally extending edges thereof in the various positions thereof for machining.

17. Apparatus according to claim 16 wherein the apparatus is fastening apparatus.

18. Apparatus according to claim 16 wherein said cantileverly supporting means comprises means for cantileverly supporting said second head means at a distance from said second frame means body portion for machining of a substantially semi-cylindrical workpiece held between said first and second head means over the curvature thereof without refixturing of the workpiece.

19. Apparatus comprising first and second head means which are located along an axis for machining a curvilinear workpiece held therebetween, a first frame means shaped to define a throat having an entrance and supporting said first head means at said throat entrance, said first frame means being disposed substantially in a plane and said workpiece having a longitudinal axis disposed substantially perpendicular to said plane, a second frame means shaped to define a throat and disposed at least partially in said first frame means throat and supporting said second head means, means for moving said second frame means while maintaining said second head means in alignment with said first head means whereby an edge portion of an arcuate workpiece which is fixtured may be received in the second frame means throat while another portion thereof is held between the first and second head means for machining over the workpiece curvature without refixturing of the workpiece, means for moving the fixtured workpiece between said first and second head means for positioning of the workpiece at various positions thereof for machining, means for mounting said second frame means for rotating about said axis to provide clearance of the workpiece including the longitudinally extending edges thereof in the various positions thereof for machining.

20. Apparatus according to claim 19 wherein the apparatus is fastening apparatus.

* * * * *